United States Patent [19]

Niemi et al.

[11] Patent Number: 4,811,907

[45] Date of Patent: Mar. 14, 1989

[54] METHOD AND APPARATUS FOR IMPROVING THE GRINDING RESULT OF A PRESSURE CHAMBER GRINDER

[75] Inventors: Jouko Niemi, Pirkkala; Kaarlo Pyöriä, Tampere; Heikki Korhonen, Pori, all of Finland

[73] Assignees: OY Finnpulva AB; Kemira OY, both of Finland

[21] Appl. No.: 88,159

[22] PCT Filed: Nov. 20, 1986

[86] PCT No.: PCT/FI86/00130

§ 371 Date: Jul. 24, 1987

§ 102(e) Date: Jul. 24, 1987

[87] PCT Pub. No.: WO87/03219

PCT Pub. Date: Jun. 4, 1987

[30] Foreign Application Priority Data

Nov. 26, 1985 [FI] Finland ..... 854671

[51] Int. Cl.[4] ..... B02C 19/06

[52] U.S. Cl. ..... 241/5; 241/29; 241/39; 241/152 R

[58] Field of Search ..... 241/5, 39, 40, 152 R, 241/29, 24

[56] References Cited

U.S. PATENT DOCUMENTS 4,504,017 3/1985 Andrews ..... 241/152 R X 4,586,661 5/1986 Niemi ..... 241/39 X

*Primary Examiner*—Mark Rosenbaum

*Attorney, Agent, or Firm*—McGlew & Tuttle

[57] ABSTRACT

A method and apparatus for improving the grinding result of a pressure chamber grinder includes a feeder for feeding material into a pressurized equalizing tank, then transferring the material into a pre-grinder where the material is fluidized by grinding-gas jets. The fluidized material-gas flow is divided by a bisecting device into two component flows and it is accelerated through two accelerating nozzles which are directed toward a impact point of a main grinding chamber. The grinding chamber has an outlet connected to an acceleration tube inlet which is connected at its discharge to a free-flow grinder provided with tangentially directed grinding-gas nozzles. The material which passes through the nozzles is in a ready ground final product form is removed constantly through a centrally located exhaust pipe.

11 Claims, 3 Drawing Sheets

METHOD AND APPARATUS FOR IMPROVING THE GRINDING RESULT OF A PRESSURE CHAMBER GRINDER

BACKGROUND OF THE INVENTION

1. Field of the Invention

This invention relates in general to grinding devices and in particular to a new and useful method and apparatus for improving the grinding result of a pressure chamber grinder.

The present invention particularly concerned with a method and an apparatus for improving the grinding result of a pressure chamber grinder. A pressure chamber grinder is described in U.S. Pat. No. 4,586,661. Therein the finely divided material to be ground is fed by means of a mechanical feeder device into a pressurized equalizing tank, the material, which may have been clotted, is made loose by means of a rotor in the tank, and the material that is made loose in this way is transferred into a pre-grinder. There, several grinding-gas jets are applied to the material to be ground so that the material to be ground is fluidized. The fluidized material-gas flow is passed into a bisecting device, wherein it is divided into two component flows of substantially equivalent magnitude and composition. Each component flow is passed into the main grinding chamber through its own long accelerating nozzle, which nozzles are directed so that a collision zone for the two component flows is formed in the center point of the main grinding chamber.

It is an advantage of such a pressure chamber grinder that, it is operationally economically far superior to conventional jet grinders, wherein ejectors are usually used as a feeder device.

Since in principle, in a pressure chamber grinder, the material particles to be ground are subjected to the grinding effect only once, as a rule, depending on the material to be ground, a very little proportion of the particles can pass through or by-pass the grinding zone without being crushed. Even though the proportion of this coarser material fraction in the whole material flow is, as a rule, very little, e.g. less than 1 per cent by weight, in the case of many products there is a necessity to remove these coarse particles from the ground product. In such a case, it is necessary to resort to a separate classifier, from which the coarse particles are returned, in one way or another, into the main grinding chamber for regrinding.

In practice, it has, however, been noticed that when an extremely finely divided final product is aimed at, such as in the preparation of pigments, a qualitatively and/or economically fully satisfactory final result cannot be achieved by means of any known classifier in use. This is due to the fact that the particle size of the material to be classified is at the maximum a few microns. For example, the primary crystal size of titanium dioxide pigments is of the order of 0.2 micro-meters, and the average particles size of finely divided titanium dioxide pigment grades is only slightly larger than that.

In the jet grinders in common use, in particular in the so-called disk-jet grinders, one of which is described, e.g., in the U.S. Pat. No. 2,032,827, a gas suspension of solid material ends up in a circularoty movement, whereby the centrifugal force prevents the coarse particles from escaping from the grinder until they have been ground sufficiently finely. Further developments of this basic jet grinder are described in several patents, e.g. in the U.S. Pat. No. 3,178,121. Attempts have been made to improve the ability of the basic grinder to classify and to grind the coarser and less readily grindable material fraction included in the material to be ground by to the basic grinder connecting various supplementary grinders and circulation systems for coarse material. Such methods and systems are described, e.g., in the U.S. Pat. Nos. 4,189,102 and 4,248,387. The improvements have given increased efficiency for the grinding of the coarse material, but the solutions are not energy-economically satisfactory. In many cases, the consumption of energy has been increased further. After the apparatuses have become even more complicated, their reliability in operation has suffered at the same time, in particular in the most extensive fine-grindings (pigments), because the narrow pipe systems and uneven flows result in rapid clogging of the equipment. With reduced homogeneity of the gas suspension of the solid material subject of grinding, the ability of classification of the grinder equipments has been deteriorated even if the grinding capacity has been increased. This is seen as a necessity to separate the unground fraction in order to return it to the primary grinding.

SUMMARY OF THE INVENTION

The present invention provides a grinding method and equipment which provides both high grinding efficiency of a pressure chamber grinder and the good ability of classification of a free flow grinder so that the combination becomes free from the various drawbacks of the two apparatus types at the same time. It has been noticed surprisingly that this can be achieved with an overall energy consumption that is of an order of only ½ to ⅓ of the energy required by the conventional jet grinders. This has been achieved by means of a method which is characterized in that a solids-gas mixture ground in a pressure chamber grinder is passed through an acceleration tube into a free-flow grinder so as to reach a final product of steeper particle distribution, whereby grinding as is passed into the free-flow grinder through substantially tangentially directed grinding-gas nozzles and the material-gas flow which is fed at a high velocity into the free-flow grinder, is brought into a rapid circulatory movement so that, by the effect of centrifugal force, substantially only the large particles are subjected to an efficient grinding.

By using such a solution, the desired final results is obtained without a separate classifier and substantially with the same good energy economy as in the conventional pressure chamber grinder technique, this is because in a free-flow grinder the grinding conditions are chosen so that only the oversize particles are ground and the finer particles pass through this after-grinder almost without delay. In such a case, in the after-grinder no more energy is required than in a conventional classification process. In the solution in accordance with the present invention, it has been possible to reduce the energy consumption even to one third of the energy consumption of apparatuses using an ejector feeder.

Accordingly, it is an object of the invention to provide an improved grinding apparatus in which the end of a main grinding chamber is connected to an acceleration tube which conveys material to a free flow grinder which is provided with tangentially directed grinding gas nozzles which are directed against the material which is eventually discharged.

A further object of the invention is to provide a method for improving the grinding results of a pressure chamber grinder in a system in which the material to be ground is fed by a mechanical feeder into a pressurized equalizing tank in which some of the material becomes clotted and it is made loose by engaging it with a rotor and the loosened material is transferred to a pre-grinder material is directed into a path of grinding gas jets so that the material is fluidized, passing the fluidized material gas flow into a bisecting device where it is divided into two component flows of substantially equivalent magnitude and composition, and directing each component flow into a main grinding chamber by separately passing each component through a long accelerating nozzle which feeds the material into a collision zone so that the two component flows formed in the main grinding chamber were a solid and gas mixture is formed which is directed through an acceleration tube into a free-flow grinder so as to produce a final product of steeper particle distribution and, while directing grinding gas into the free-flow grinder through substantially tangentially directed grinding gas nozzles which, during the material gas flow which is fed at a high velocity into the free-flow grinder brings the mixture into rapid circulatory movement so that it is acted upon by centrifugal force to cause the coarser material particles to stay in the grinder longer and to be ground more thoroughly than the finer particles.

A further object of the invention is to provide a grinding apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

GENERAL DESCRIPTION OF THE PREFERRED EMBODIMENTS

Figure 2:
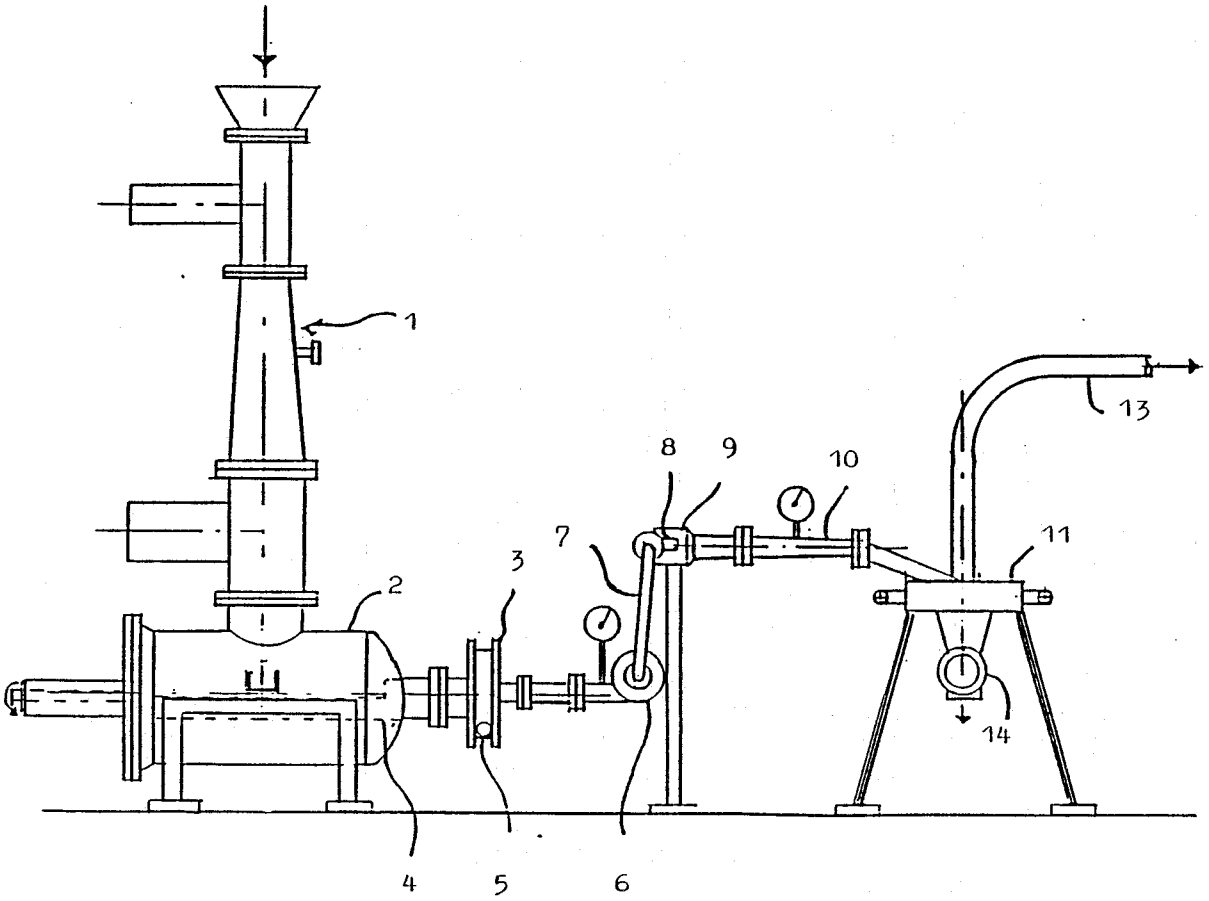
FIG. 2, is a side elevational view of an exemplifying embodiment of the apparatus of the present invention.
Figure 3:
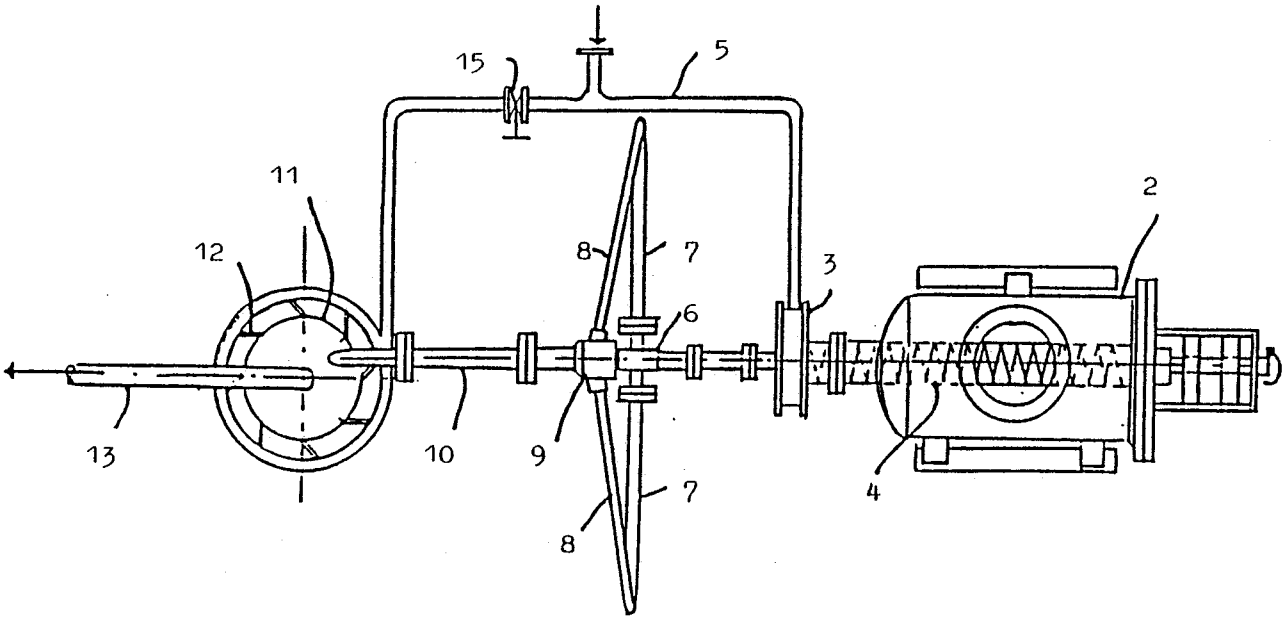
FIG. 3, is a top view of the apparatus partly in section.

The apparatus, in accordance with the invention, comprises a mechanical feeder 1, which may be either a plug feeder, by means of which the finely divided material to be ground is fed into a pressurized equalizing tank 2 as a gas-tight plug by means of a push piston, as is described in the U.S. Pat. No. 4,586,661, or a valve feeder, as is illustrated in FIGS. 2 and 3. The use of such a valve feeder is described, e.g., in the International Patent Specification No. W086/02287, so that its operation will not be described in further detail in this connection. The material, which may have been clotted in the equalizing tank, is made loose by means of a rotor (not shown) and is transferred at a preset rate into a pre-grinder 3 by means of a screw conveyor 4. In the equalizing tank 2, an approximately equal pressure is maintained as compared with the pre-grinder 3. In the pre-grinder 3, several strong grinding-gas jets are applied to the material to be ground, so that the material to be ground is fluidized. Grinding gas is passed into the pre-grinder 3 through a gas pipe 5 to produce a fluidized material and gas mixture.

The fluidized material-gas mixtures is made to rush from a pregrinder 3 into a bisecting or dividing device 6, where the material-gas jet is divided into two component flows of substantially equivalent magnitude and composition. The two outlet pipes 7 of the bisecting device 6 are connected to the two long accelerating nozzles 8 of the pressure chamber grinder. The nozzles 8 are preferably shaped like venturi tubes. The accelerating nozzles 8 are directed so that the component flows rushing through them at an increasing velocity collide with each other in a collision zone formed in the middle point of the main grinding chamber 9. A highly efficient grinding of the material particles takes place in this collision zone . If, by chance, the coarsest particles in the material-gas mixture collide in the main grinding chamber 9 only against particles of a considerably smaller size, the grinding remains incomplete in respect of these coarser particles.

When the material-gas flow coming from the main grinding chamber 9 is passed through an accelerating tube 10 into a free-flow grinder or disc grinder 11, into which grinding gas is passed through substantially tangentially directed grinding-gas nozzles 12, the solids-gas mixture rushing into this grinder 11 at a high velocity is forced into a rapid circulatory movement so that, by the effect of centrifugal force, the coarsest particles stay in this grinder 11 longer and become ground more thoroughly than the finer particles, which escape from the free-flow grinder 11 almost immediately, through its exhaust pipe 13, which is placed centrally.

Such an apparatus is excellently suitable for the grinding of various pigments, in paritcular for the grinding of titanium dioxide pigments. In the case of pigments, e.g. titanium dioxide, the basic grinding in the pressure chamber grinder part of the equipment is already so efficient that the major part of the material becomes ground therein sufficiently fine (almost to primary crystals), and the proportion of an excessively coarse material fraction in the product flow is very little, often lower than one per cent by weight in the whole material quantity. Since these excessively coarse particles are also of very small size, in the latter grinder a very good classification efficiency and only little grinding power are required.

The grinding conditions should preferably be chosen so that the sufficiently fine material passes through the free-flow grinder rapidly and that only the excessively large particles become ground. By adjusting the grinding-gas feeds so that a positive pressure of about 0.5 to 1.0 bar prevails in the grinding chamber of the pressure chamber grinder, the flow velocity of the solids-gas suspension at the final end of the accelerating tube 10 becomes higher than 250 m/s. Thereby, highly advantageous grinding conditions are obtained in the free-flow grinder 11.

According to the present invention, it is possible to use compressed air as the grinding gas both in the pressure chamber grinder part and in the free-flow grinder, but it is also possible to use, e.g., compressed air in the pressure chamber part and steam in the free-flow grinder, or the other way around.

As the free-flow grinder 11, it is possible to use, e.g., a conventional disk grinder, into which the homogeneous pre-ground gas suspension is passed at a high velocity through the accelerating tube 10 without a conventional ejector feed. The grinding-gas nozzles 12 terminate at the mantle face of the grinding chamber. The feed through the accelerating tube 10 is guided so close to the outer circumference of the grinding chamber that an efficient collision with the gas flows discharged out of the nozzles 12 is produced. Thus, the feed point is preferably outside th circle that is contacted by the gas flows discharged out of the nozzles 12 tangentially. This location, as well as the high velocity in the accelerating tube 10, also guarantee an efficient classification in the grinder chamber. One end wall of the disk grinder 11 is provided with an exhaust pipe 13, which terminates in a gas separator, where the finished product is separated from the grinding gas.

In order to reduce the strain on the gas separator, it is possible to install a closing feeder at the opposite end wall of the disk grinder 11, through which feeder part the final product is removed. The gas pipe 5 is provided with a control valve 15 for the control of the pressure prevailing in the disk grinder and of its grinding efficiency.

On the accelerating tube 10, whose shape is preferably that of a venturi tube, a manometer may be installed in order to permit observation of the pressure prevailing in the tube 10.

Instead of a disk grinder 11, it is also possible to use a socalled tube grinder as the free-flow grinder 11, in which said tube grinder the material to be ground is circulated along a closed path and the final product is removed through a centrally placed exhaust opening into the gas separator.

Figure 1:
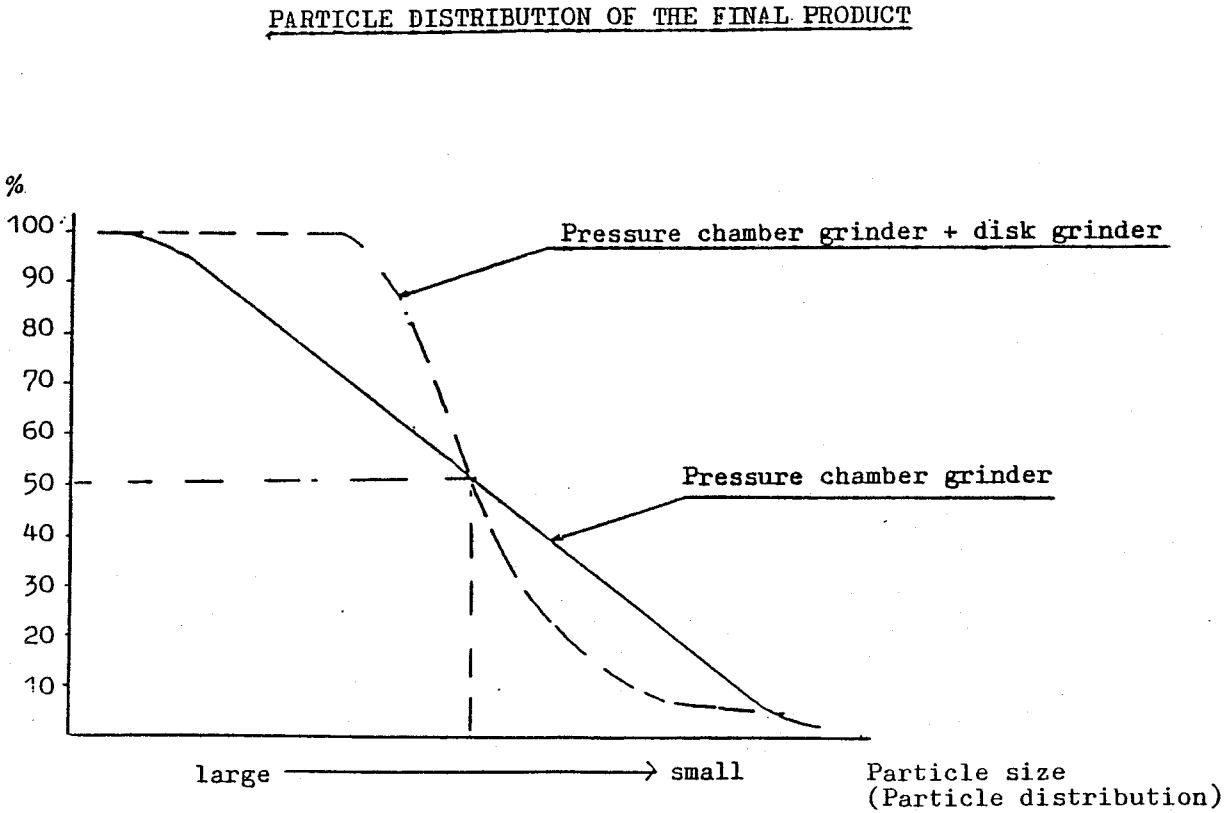
FIG. 1, is a curve showing the particle distribution of the final product when a pressure chamber grinder alone is used as well as when a solution in accordance with the present invention; in used.

From the graph of FIG. 1 it is seen clearly how much steeper the particle distribution in that is obtained by means of a solution in accordance with the present invention as compared with the use of a pressure chamber grinder alone. The vertical parameter is the percentage of penetration of the final product, and the horizontal parameter is the particle size of the particles. Since both curves intersect each other at the penetration value of 50%, the average particle size with both of the methods is the same.

In the case of pigments, in particular of titanium dioxide pigments, the change produced by the after-grinder in the particle-size distribution curve is not equally clear, because, out of the whole material quantity, the proportion to be ground in the after-grinder is little, From the point of view of the quality and usability of the product, the improvement that can be achieved is, however of great importance. Pigments are used most of all in the paint industry, and considerable quantities also used in plastics and fibre industries. A minute proportion by weight of coarse particles is enough to produce detrimental nubs or holes in thin paint or plastic films.

While specific embodiments of the invention have been shown and described in detail to illustrate the application of the principles of the invention, it will be understood that the invention may be embodied otherwise without departing from such principles.

What is claimed is:

1. A method for improving the grinding result of a pressure chamber grinder, wherein a finely divided material to be ground is fed by means of a mechanical feeding device into a pressurized equalizing tank and the material, which may become clotted in the equalizing tank is made loose by engaging it with a rotor, and the material which is made loose in this way is transferred into a pre-grinder, comprising directing the material into the path of grinding-gas jets applied so that the material to be ground is fluidized, passing the fluidized material and gas mixture flow into a bisecting device so as to cause it to be divided into two component flows of substantially equivalent mangitude and composition, directing each component flow into a main grainding chamber by separately passing each component through a long accelerating nozzle, discharging the nozzles against a collision zone for the two component flows in order to grind the material and to form a homogenous solid gas suspension, passing and accelerating the suspension, by using residual pressure prevailing in the main grinding chamber, through an accelerating tube at high velocity into a free-flow grinder while directing grinding gas into said free flow grinder through substantially tangentially directed grinding-gas nozzles so as to bring the suspension into a rapid circulatory movement so that, by the effect of centrifugal force, coarser material particles stay in this grinder longer and are ground more thoroughly than finer particles.

2. A method according to claim 1, wherein the grinding conditions are chosen so that only the oversized particles are ground in the free-flow grinder.

3. A method according to claim 1, wherein a positive pressure of from 0.5 to 1.0 bar prevails in the main grinding chamber.

4. A method according to claim 3, wherein compressed air is used as a grinding gas in the pressure chamber grinder part of the free-flow grinder.

5. A method according to claim 1, wherein compressed air is used as a grinding gas in the pressure chamber grinder part and steam is used in the free-flow grinder.

6. A grinding apparatus of the kind including a pressurized equalizing tank into which material is fed by a mechanical feeder, the tank having a rotor for loosening any clotted material in the tank, a pre-grinder having a loose material inlet and means for directing grinding gas jets into the loose material to fluidize the material, a bisecting device connected to said pre-grinder having an inlet for the fluidized material and having means for separating the fluidized material into two separate fluid flow paths of substantially equal magnitude and composition, means defining an accelerating nozzle in each fluid flow path, means defining a main grinding chamber connected to said tube fluid flow path and having an impact area against which each flow path is directed so as to collide with each other, said main grinding chamber having a discharge adjacent said impact area, the improvement comprising an acceleration tube having an inlet connected to said main grinding chamber discharge and having an acceleration tube discharge, a free-flow grinder connected to said acceleration tube discharge and having a tangentially directed grinding gas nozzle impacting against the material, and an exhaust pipe means connected to said free flow grinder at a central location thereof for removing the material from the free-flow grinder.

7. Apparatus as claimed in claim 6, characterized in that the free-flow grinder (11) consists of a conventional disk grinder, in whose mantle face the grinding-gas nozzles (12) terminate and in one of whose end walls, at the centre axis, the exhaust pipe (13) is arranged, which said exhaust pipe terminates in a gas separator.

8. Apparatus as claimed in claim 7, characterized in that the acceleration tube (10) terminates in the efficient grinding and classification zone in the disk grinder so that the feed point is outside the circle that is contacted by the gas jets discharged from the grinding gas nozzles (12) tangentially.

9. Apparatus as claimed in claim 7 or 8, characterized in that a closing feeder (14) is provided centrally in the opposite end wall, part of the final product being removed out of the disk grinder (11) through the said closing feeder.

10. Apparatus as claimed in claim 9, characterized in that the acceleration tube (10) has the shape of a venturi tube and is provided with a manometer for indication of the pressure prevailing in the tube (10).

11. Apparatus as claimed in claim 6, characterized in that the free-flow grinder is of the tube grinder type, wherein the material to be ground is circulated along a closed path.

* * * * *